US008028376B2

(12) United States Patent
Karapetyan

(10) Patent No.: US 8,028,376 B2
(45) Date of Patent: Oct. 4, 2011

(54) DOOR SAFETY MECHANISM

(76) Inventor: Albert Karapetyan, Valencia, CA (US)

( * ) Notice: Subject to any disclaimer, the term of this patent is extended or adjusted under 35 U.S.C. 154(b) by 373 days.

(21) Appl. No.: 12/300,543

(22) PCT Filed: Sep. 12, 2008

(86) PCT No.: PCT/US2008/076327

§ 371 (c)(1),
(2), (4) Date: Nov. 12, 2008

(87) PCT Pub. No.: WO2010/030286

PCT Pub. Date: Mar. 18, 2010

(65) Prior Publication Data

US 2010/0107362 A1 May 6, 2010

(51) Int. Cl.
*E05F 5/02* (2006.01)

(52) U.S. Cl. ..... 16/82; 16/86 A; 292/262

(58) Field of Classification Search ..... 16/82, 83, 16/86 R, 86 A, 86 B; 292/289, 297, 298, 292/338, 339, 342, DIG. 15, 262
See application file for complete search history.

(56) References Cited

U.S. PATENT DOCUMENTS

| | | | | |
|---|---|---|---|---|
| 463,821 | A | 11/1891 | Wright | |
| 896,242 | A | 8/1908 | Ralston | |
| 3,200,434 | A | 8/1965 | Jarnot | |
| 3,620,483 | A * | 11/1971 | Weinberger | 292/262 |
| 3,758,141 | A * | 9/1973 | Weinberger | 292/262 |
| 4,028,772 | A | 6/1977 | Salerno | |
| 4,165,553 | A | 8/1979 | Salerno | |
| 4,443,508 | A | 4/1984 | Mehl | |
| 4,765,662 | A * | 8/1988 | Suska | 292/92 |
| 4,982,474 | A * | 1/1991 | Kjellstrom | 16/82 |
| 5,123,685 | A * | 6/1992 | Donovan | 292/262 |
| 5,369,840 | A | 12/1994 | Salvador et al. | |
| 5,542,725 | A * | 8/1996 | Ballew | 292/339 |
| 5,740,585 | A | 4/1998 | Shapiro | |
| 5,813,091 | A | 9/1998 | Chaumat | |
| 6,327,743 | B1 * | 12/2001 | Rashid et al. | 16/82 |
| 6,550,186 | B2 | 4/2003 | Haq | |
| 6,874,198 | B2 | 4/2005 | Renaud | |
| 2002/0157319 | A1 | 10/2002 | Haq | |
| 2004/0055220 | A1 | 3/2004 | Lohman | |
| 2005/0229358 | A1 * | 10/2005 | Barone | 16/82 |

FOREIGN PATENT DOCUMENTS

| | | | |
|---|---|---|---|
| CA | 1021116 | A * | 11/1977 |
| DE | 10010714 | | 9/2001 |
| EP | 1035292 | | 3/2000 |
| GB | 1256771 | | 8/1969 |
| GB | 2198173 | | 11/1986 |
| KR | 20-0207162 | | 12/2000 |
| KR | 20-0397227 | | 9/2005 |
| WO | WO9747842 | | 3/1997 |
| WO | WO0045019 | | 1/2000 |
| WO | WO2006066307 | | 6/2006 |

* cited by examiner

*Primary Examiner* — Chuck Y. Mah
(74) *Attorney, Agent, or Firm* — Christopher Wood; Daniel Eisenberg; Premier Law Group, PLLC

(57) ABSTRACT

A door safety device, comprising: a door clasp, an anti-door-closing member, and a casing. The anti-door-closing member includes an elongated stem having opposite proximal and distal ends, wherein the proximal end comprises a raised spacer, and wherein the distal end of the elongated stem includes a stem button.

2 Claims, 17 Drawing Sheets

| | |
|---|---|
| 100 | door safety device 100 |
| 105 | door clasp 105 |
| 110 | anti-door-closing member 110 |
| 112 | exterior facing surface 112 |
| 115 | casing 115 |
| 118 | doorframe 118 |
| 120 | door panel 120 |
| 125 | casing 115 has a proximal facing end 125 |
| 130 | casing 115 has a distal facing end 130 |
| 132 | casing 115 has a through-bore 132 |
| 140 | hinged side edge 140 |
| 160 | side edge 160 |
| 180, 200 | upper end 180, lower end 200 |
| 220, 240 | interior face 220, exterior face 240 |
| 260 | door handle 260 |
| 300 | first elongated side 300 |
| 305 | exterior surface 305 of first side 300 |
| 320 | second elongated side 320 |
| 340 | closed proximal end 340 |
| 345 | interior width 345 |
| 347, 349 | first and second interior sides 347 and 349 |
| 360 | open distal end 360 |
| 380, 400 | first and second distal ends 380 and 400 |
| 420 | gap 420 located between ends 380 and 400 |
| 440 | elongated stem 440 |
| 460 | proximal end 460 of anti-door-closing member 110 |
| 480 | distal end 480 of anti-door-closing member 110 |
| 500 | raised spacer 500 |
| 520, 522 | stem button 520, stem button side 522 |
| 540 | door-door frame gap 540 |
| 550 | distance 550 |
| 560 | slope 560 |
| 580 | fastener hole 580 |
| 600 | fastener 600 |
| 620, 640 | first and second layers of high coefficient of friction material 620 and 640 |

*Fig. 17*

DOOR SAFETY MECHANISM

TECHNICAL FIELD

This invention relates generally to safety devices. More specifically, the present invention speaks to an apparatus for preventing a closing door from doing harm to the fingers of a person, especially a child, whose hand might be positioned in the path of a closing door.

BACKGROUND ART

As described in U.S. Pat. No. 5,813,091 issued to Chaumat, doors generally comprise a door panel hinged in a doorframe about a hinge. This type of door presents an accident risk whenever the hinged door panel closes suddenly in the doorframe. A person, in particular a child, having a hand resting on the upright of the frame that is remote from the hinge, runs the risk of having the digits on a hand jammed between the door frame and the hinged door panel.

As noted in U.S. Pat. No. 6,550,186 issued to Haq, the sickening sound of a fast-closing door crunching against fingers which move too slowly is only secondary to the excruciating pain felt by the person whose fingers happen to be caught by the slamming door. Whatever the merits of the Haq invention, the Haq invention only works well with fast-closing doors.

SUMMARY OF THE INVENTION

A door safety device, comprising: a door clasp, an anti-door-closing member, and a casing. The anti-door-closing member includes an elongated stem having opposite proximal and distal ends, wherein the proximal end comprises a raised spacer, and wherein the distal end of the elongated stem includes a stem button.

BRIEF DESCRIPTION OF THE DRAWINGS

FIG. 17 shows a table listing part numbers.

BEST MODES FOR CARRYING OUT THE INVENTION

This invention is directed to a door safety device. More specifically, the present invention is a door safety device for preventing a closing door from causing harm to the fingers of a person, especially a child, whose hand might be positioned in the path of a closing door. The door safety device of the present invention is denoted generally by the numeric label "100".

Figure 2:
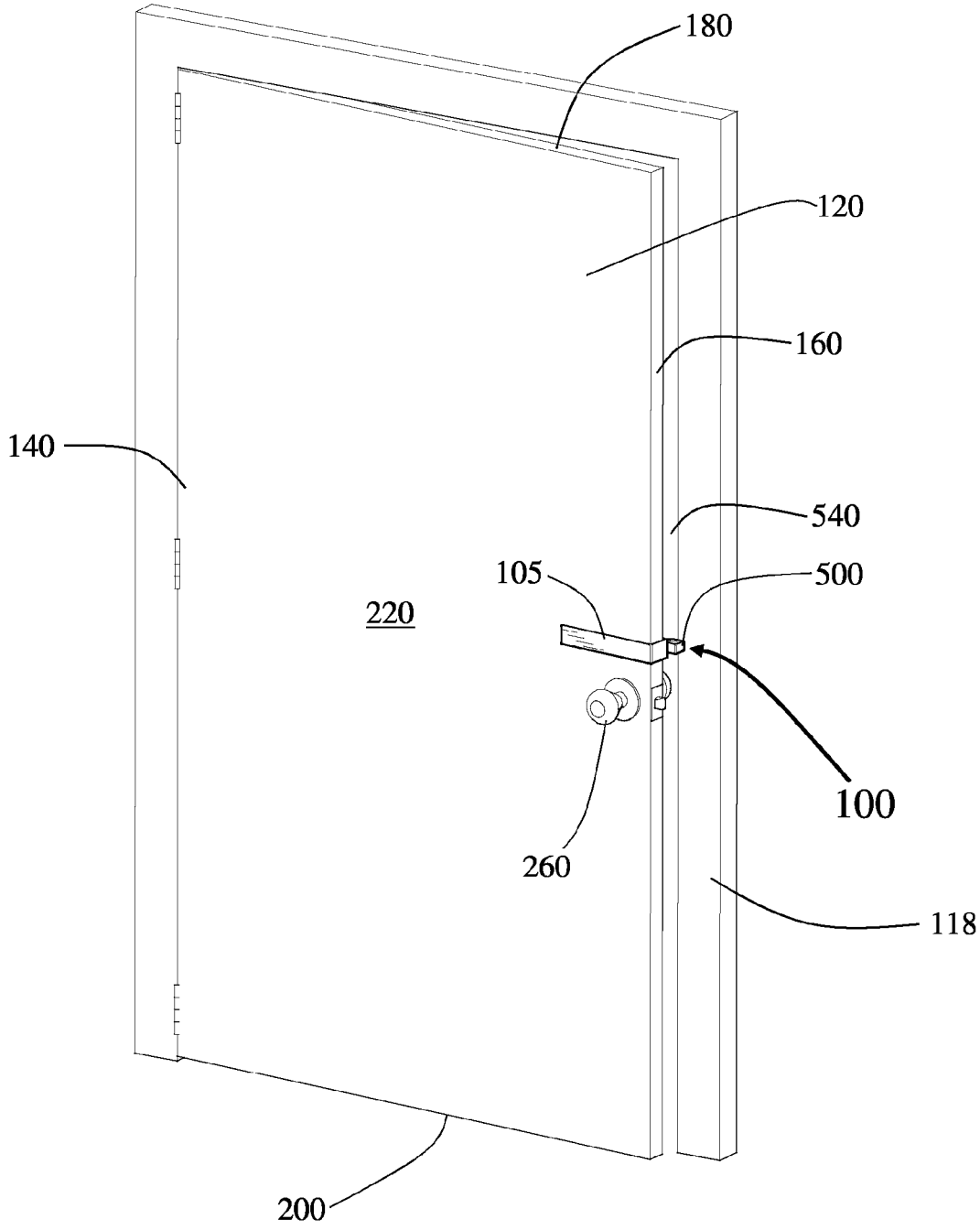
FIG. 2 shows a perspective slightly elevated environmental view of the door safety device shown in FIG. 1.
Figure 3:
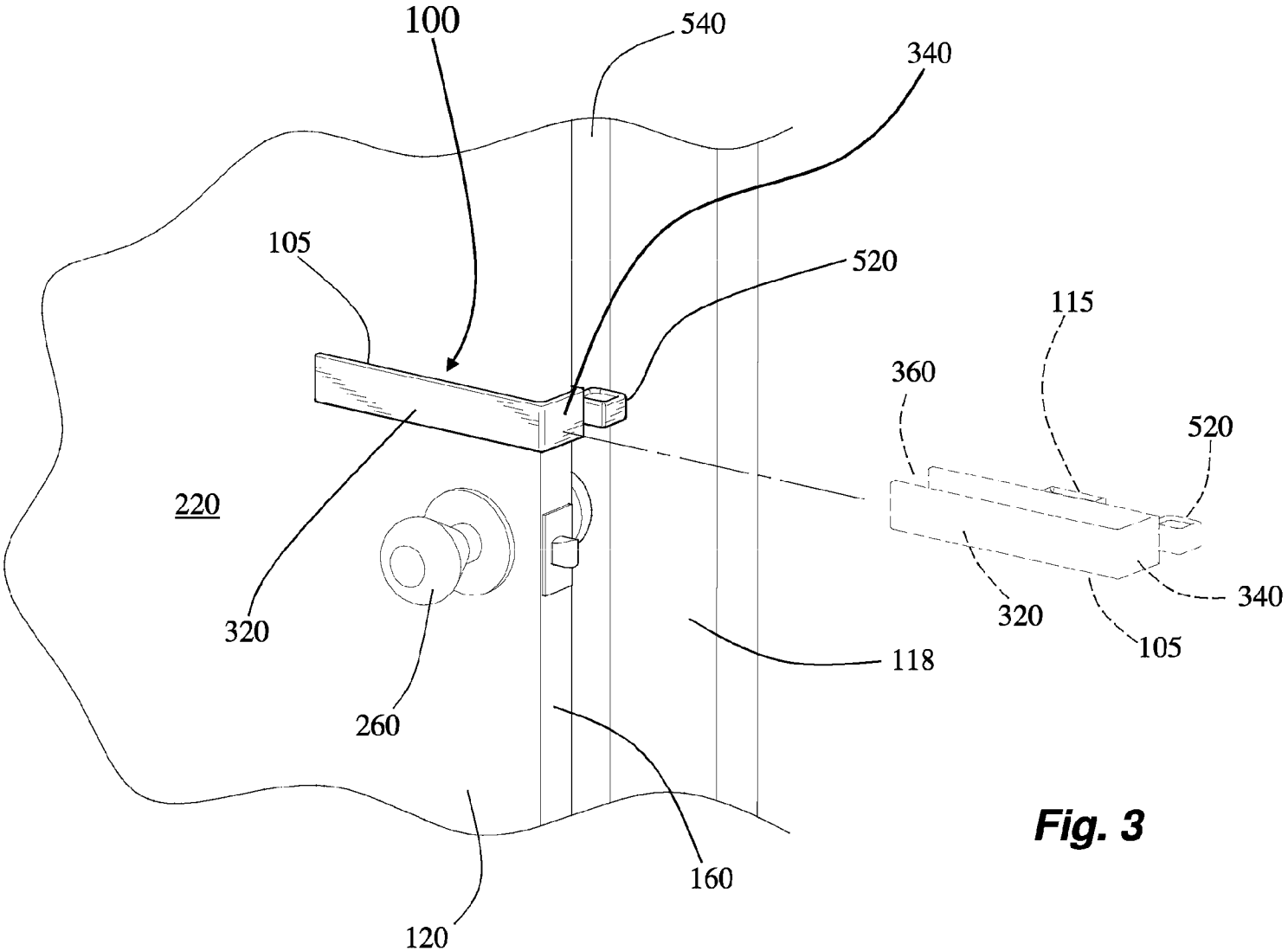
FIG. 3 shows an environmental view of the door safety device shown in FIG. 1.
Figure 4:
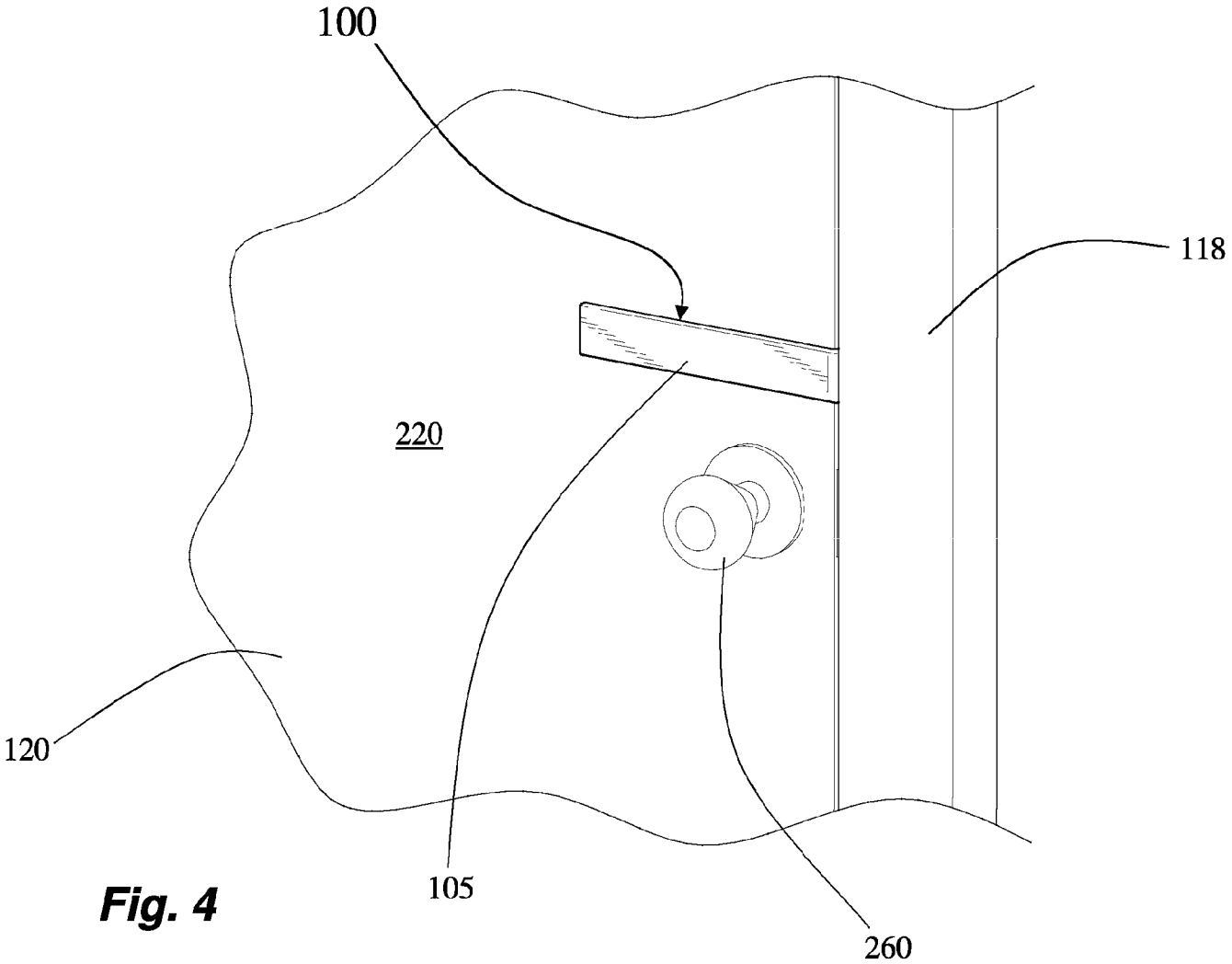
FIG. 4 shows an environmental view of the door safety device shown in FIG. 1.

In normal use the door safety device 100 is typically, but not exclusively, fitted to a door panel such as, but not limited to, a door panel 120, the door panel 120 having a hinged side edge 140, a side edge 160 located opposite the hinged side edge 140, an upper end 180, a lower end 200, an interior face 220 (shown in FIG. 2), an exterior face 240 (shown in FIGS. 9 and 10) and a door handle 260 attached to the door panel 120 proximate to the side edge 160 opposite the hinged side edge 140 of the door panel 120. The door panel 120 typically operates inside or proximate to a doorframe 118.

The door safety device 100 can be fitted at any suitable place along the door edge 160 such as near the upper end 180 of the door panel 120 out of reach of, for example, small children.

Referring now to the Figures with regard to which the meaning of labels and numbers shown in the Figures are described in the table shown in FIG. 17.

Referring to the FIGS. 1 through 10, the door safety device 100 is made up of a door clasp 105, an anti-door-closing member 110, and a casing 115. The door clasp 105 is of generally U-shaped configuration and sized and shaped to provide a snug fit over door edge 160. The door clasp 105 has opposite first 300 and second 320 elongated sides, a closed proximal end 340 and an open distal end 360 (shown, for example, in FIG. 3). Opposite first 300 and second 320 elongated sides respectively define first 380 and second 400 distal ends separated by a gap 420 therebetween, wherein first end 380, second end 400 and gap 420 therebetween collectively define open distal end 360; sides 300 and 320 also define first and second interior sides 347 and 349 (see, e.g., FIG. 5). During normal use open distal end 360 fits over the side edge 160 of door panel 120 (see, e.g., FIGS. 2 through 4, 9 and 10).

Figure 1:
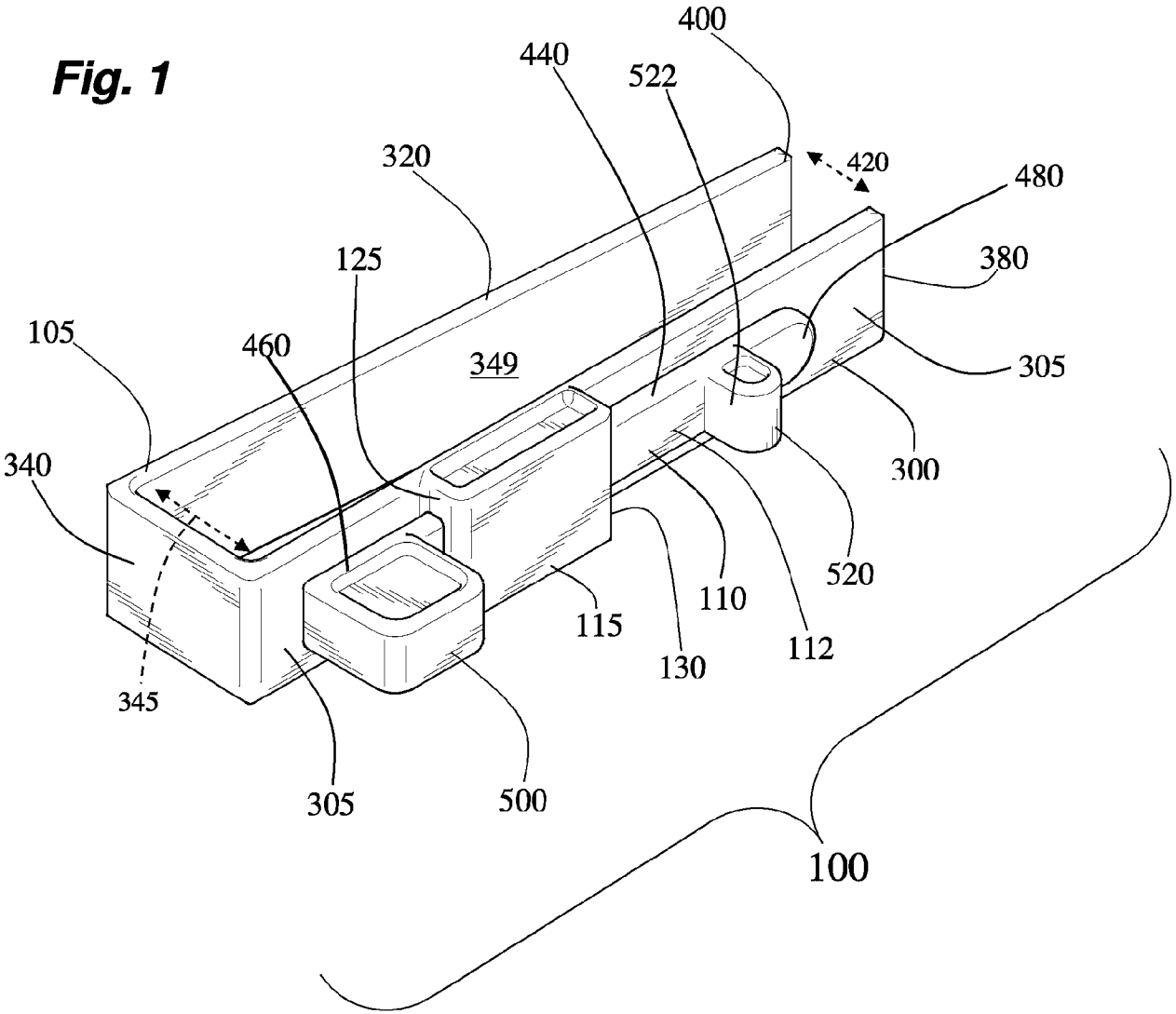
FIG. 1 shows a perspective view of a door safety device according to the present invention.

The door clasp 105 can take any suitable form such as, but not limited to, a generally rectangular open-ended U-shape as shown, for example, in FIG. 1. For doors with a curved side edge, e.g., a door panel with a side edge 160 having a rounded or curved shape, the closed proximal end 340 can have a complementary rounded profile to enable the door safety device 100 to be fitted snuggly to a door having a curved or rounded side edge 160. In one embodiment, when not in use the closed proximal end 340 is wider than the gap 420 at open distal end 360 thus ensuring tight fit over side edge 160; and conversely gap 420 is narrower than the interior width 345, wherein interior width 345 is defined as the width between first and second interior sides 347 and 349 closest to proximal end 340. More specifically, an adult can grasp and then move first 380 and second 400 ends apart thereby widening gap 420 until open distal end 360 can be fitted over side edge 160.

Figure 13:
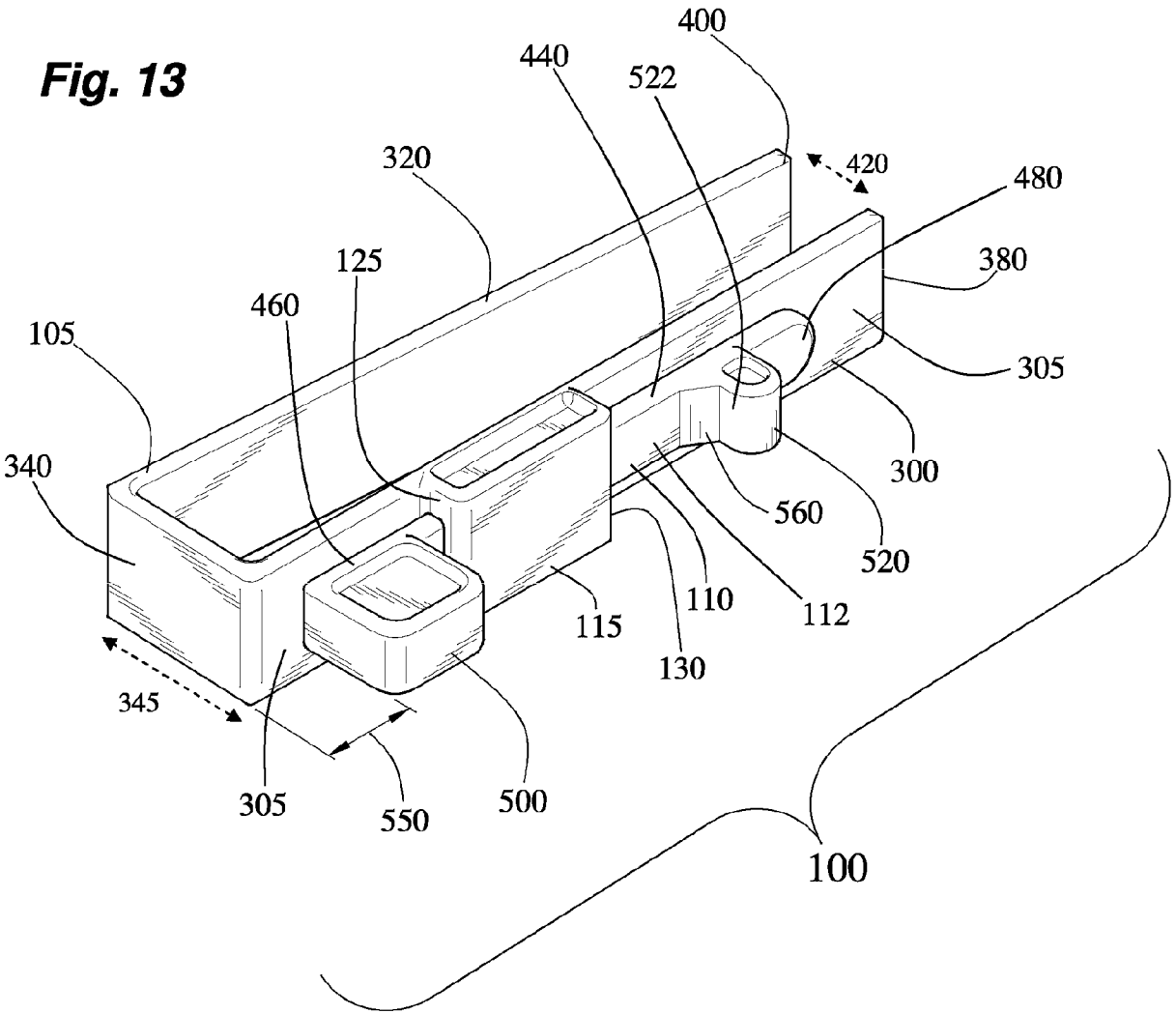
FIG. 13 shows a perspective view of the door safety device according to the present invention.
Figure 14:
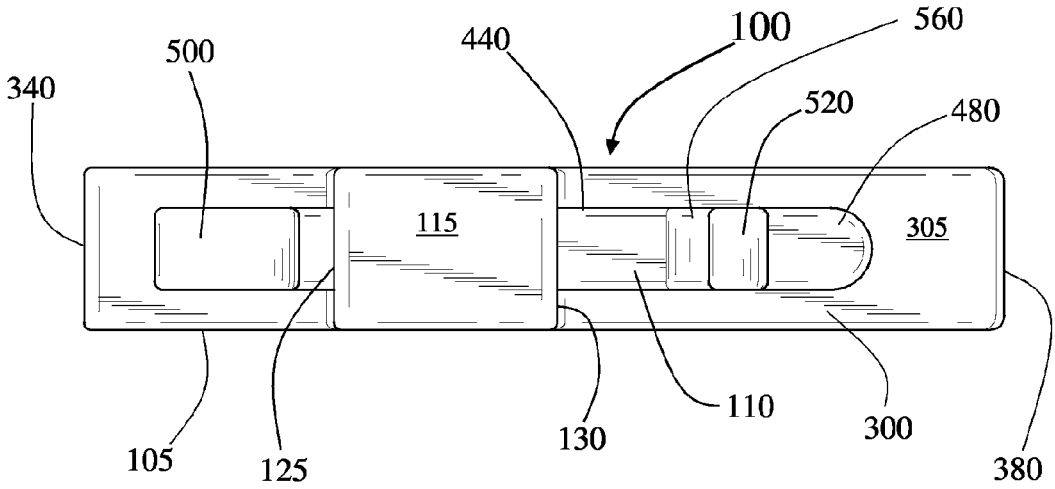
FIG. 14 shows a side view of the door safety device shown in FIG. 13.
Figure 15:
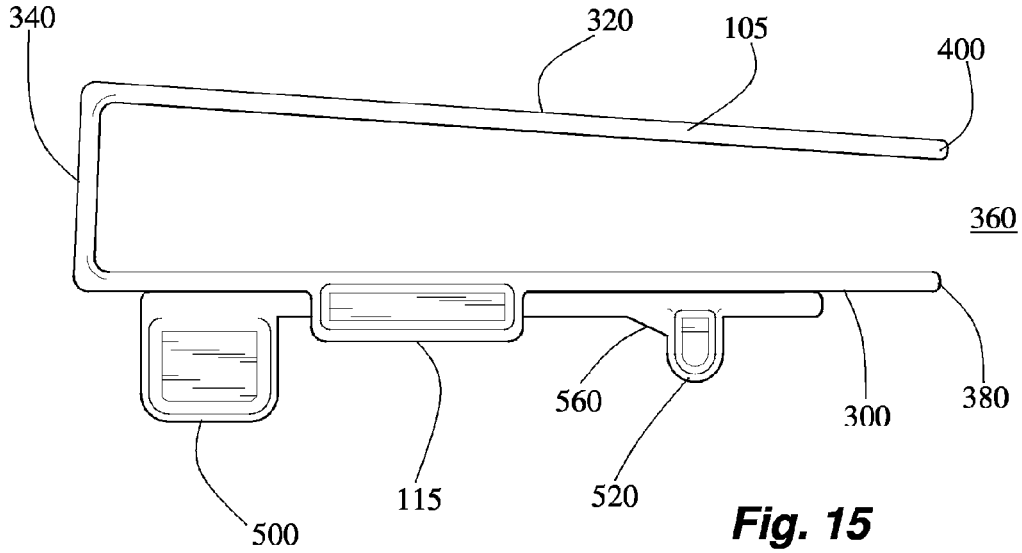
FIGS. 15 and 16 respectively show top and bottom views of the door safety device shown in FIG. 13.
Figure 16:
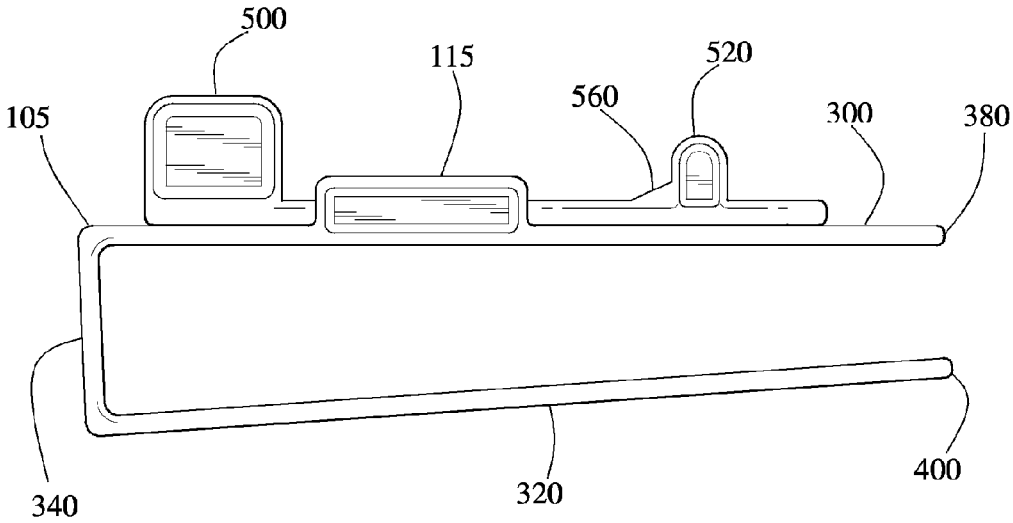
Figure 18:
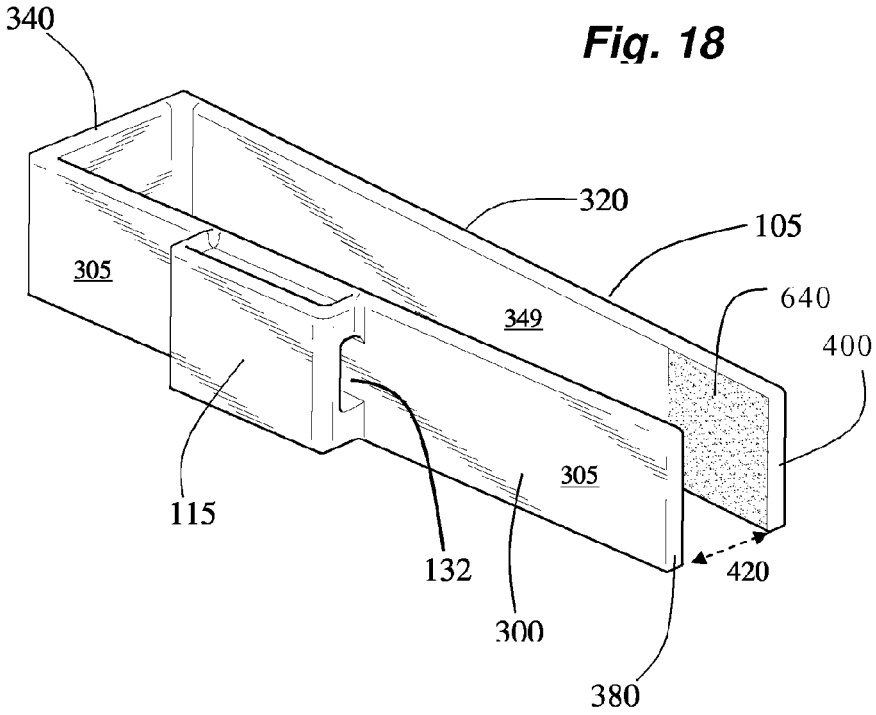
FIGS. 18 and 19 show additional views perspective views of a door safety device according to the present invention.

The anti-door-closing member 110 includes an elongated stem 440 having opposite proximal 460 and distal 480 ends, wherein the proximal end 460 comprises a raised spacer 500, and wherein the distal end 480 of the elongated stem 440 includes a stem button 520; stem button 520 defines side 522, wherein side 522 faces the distal facing end 130 of casing 115. The distance 550 between raised spacer 500 in its retracted position abutting against proximal facing casing end 125 (see, e.g., FIG. 13) and the proximal closed end 340 should be sufficient to allow clearance to allow a door fitted with the device 100 to close in instances where door frame molding is found fitted around door frames. For example, the distance 550 can be about ⅝" (five eighths of an inch).

Figure 5:
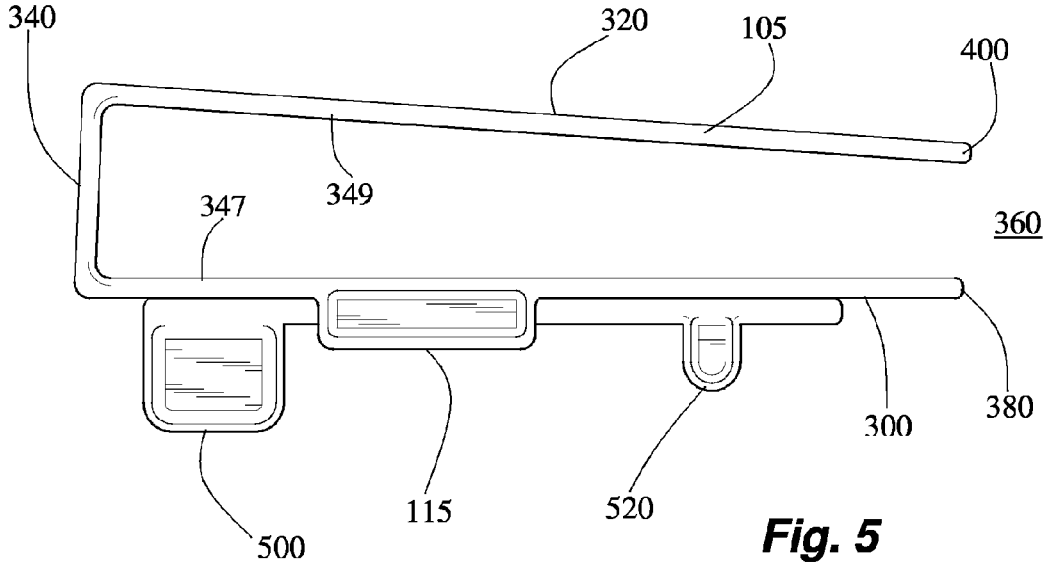
FIGS. 5 and 6 respectively show top and bottom views of the door safety device shown in FIG. 1.
Figure 6:
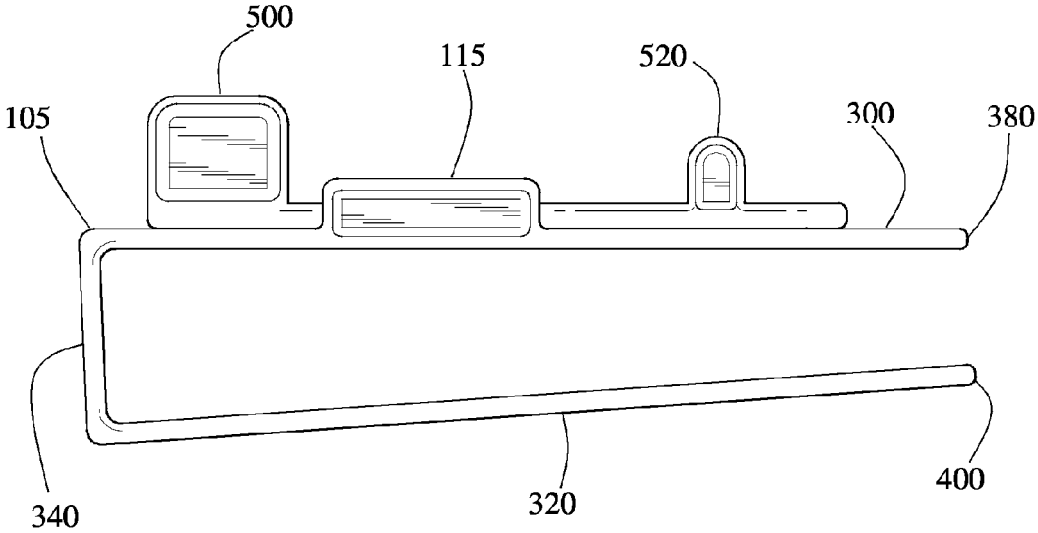
Figure 7:
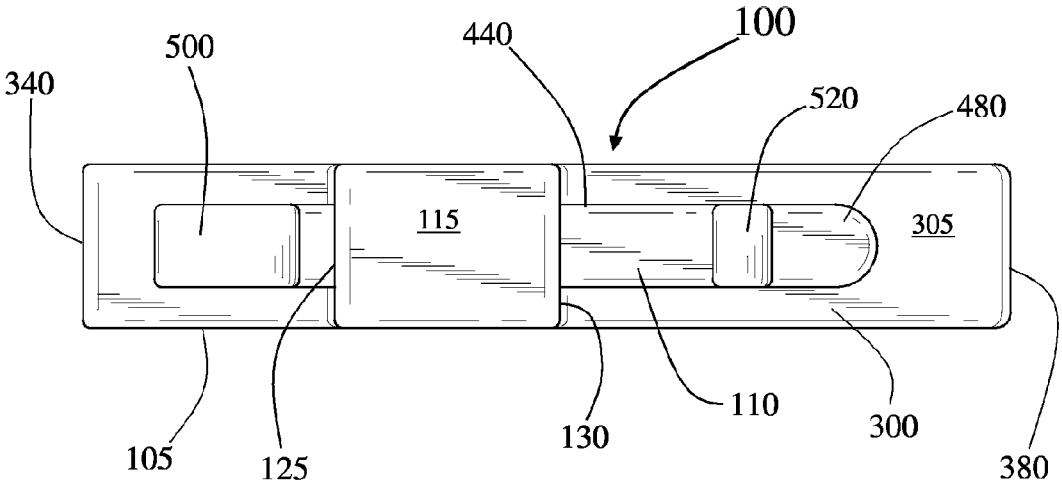
FIGS. 7 and 8 show side views of the door safety device shown in FIG. 1.
Figure 8:
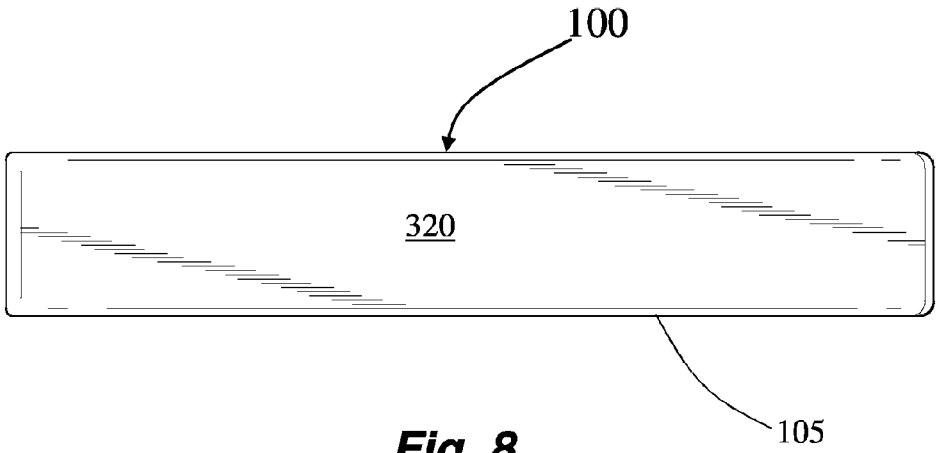
Figure 9:
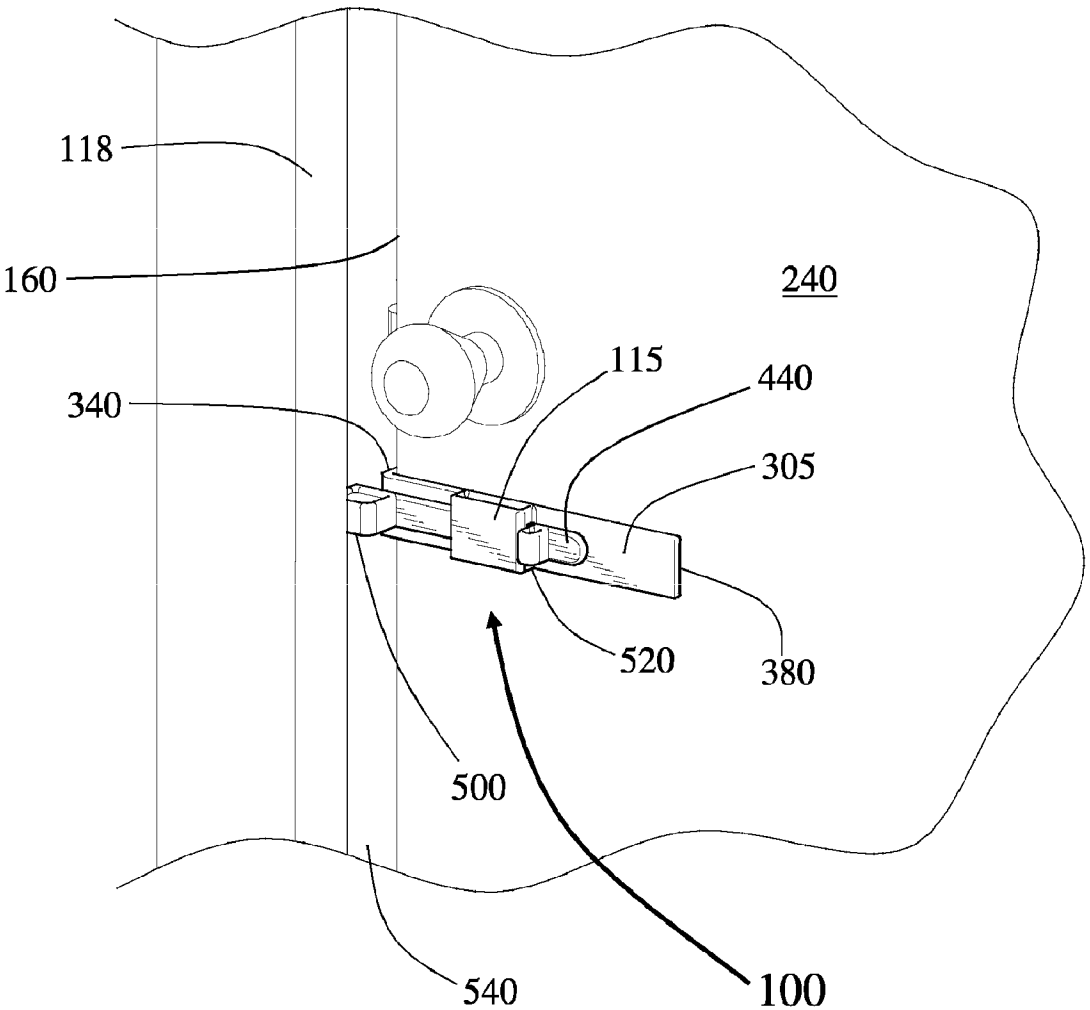
FIG. 9 shows an environmental view of the door safety device shown in FIG. 1.
Figure 10:
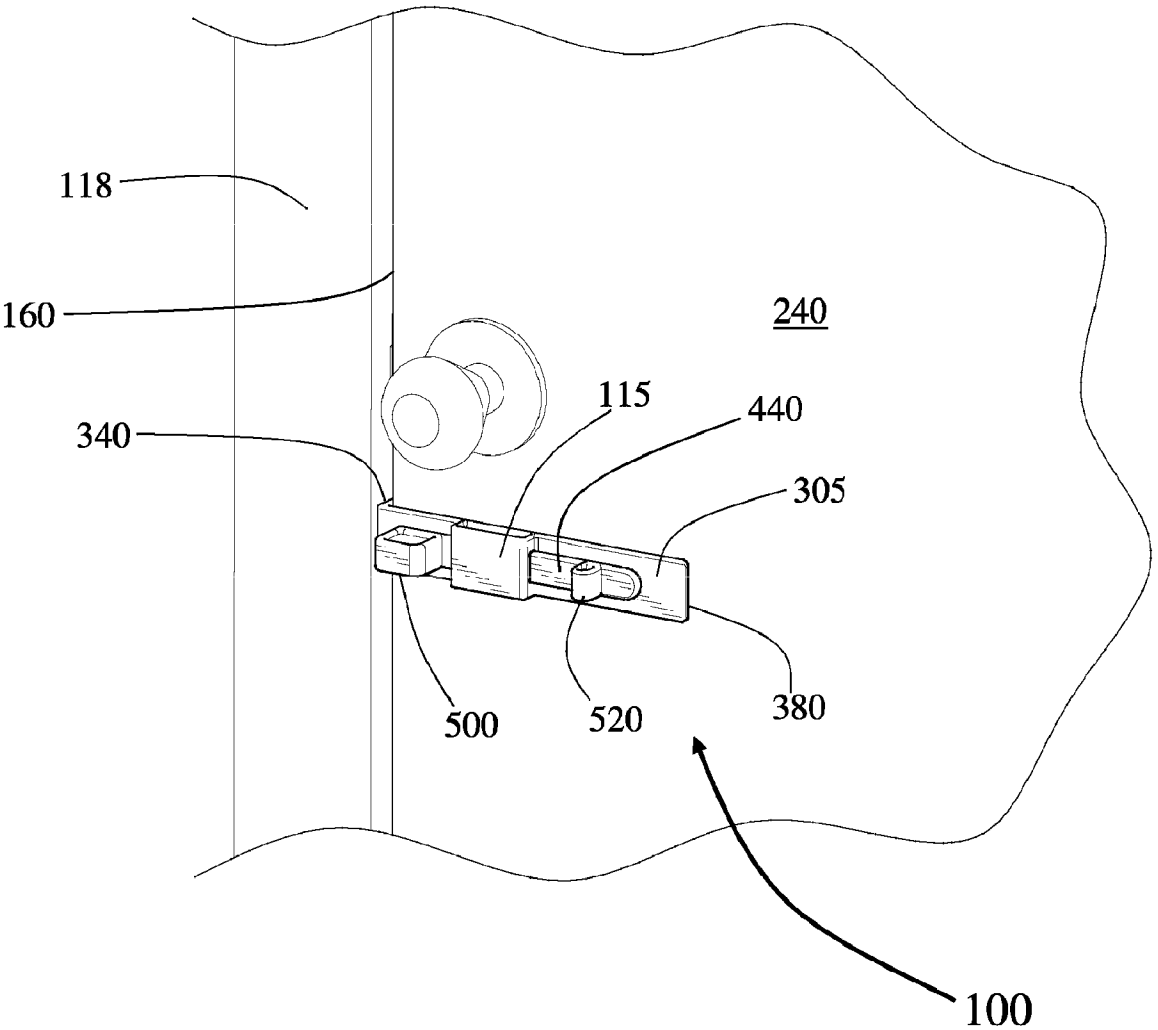
FIG. 10 shows an environmental view of the door safety device shown in FIG. 1.

The stem 440, and hence the anti-door closing member 110, is slidably secured by casing 115 (shown in, e.g., FIGS. 5 through 7). The anti-door closing member 110 defines an exterior facing surface 112. The anti-door closing member 110 is moveable between an extended position and a retracted position as shown in FIGS. 9 and 10, respectively. In the extended position the raised spacer 500 extends beyond closed proximal end 340. In the extended position the raised spacer 500 generates a door-door frame gap 540 upon contact of the raised spacer 500 with the doorframe 118 (see, e.g., FIG. 2). The raised spacer 500 is sized to generate a door-door frame gap 540 of sufficient width to accommodate the fingers or thumb of a person's hand, such as the fingers and/or thumb of a child's hand, thereby preventing a slamming door from slamming hard on the digits of a person's hand, such at the fingers or thumb of a child's hand placed inadvertently between side edge 160 and the door frame 118.

Figure 11:
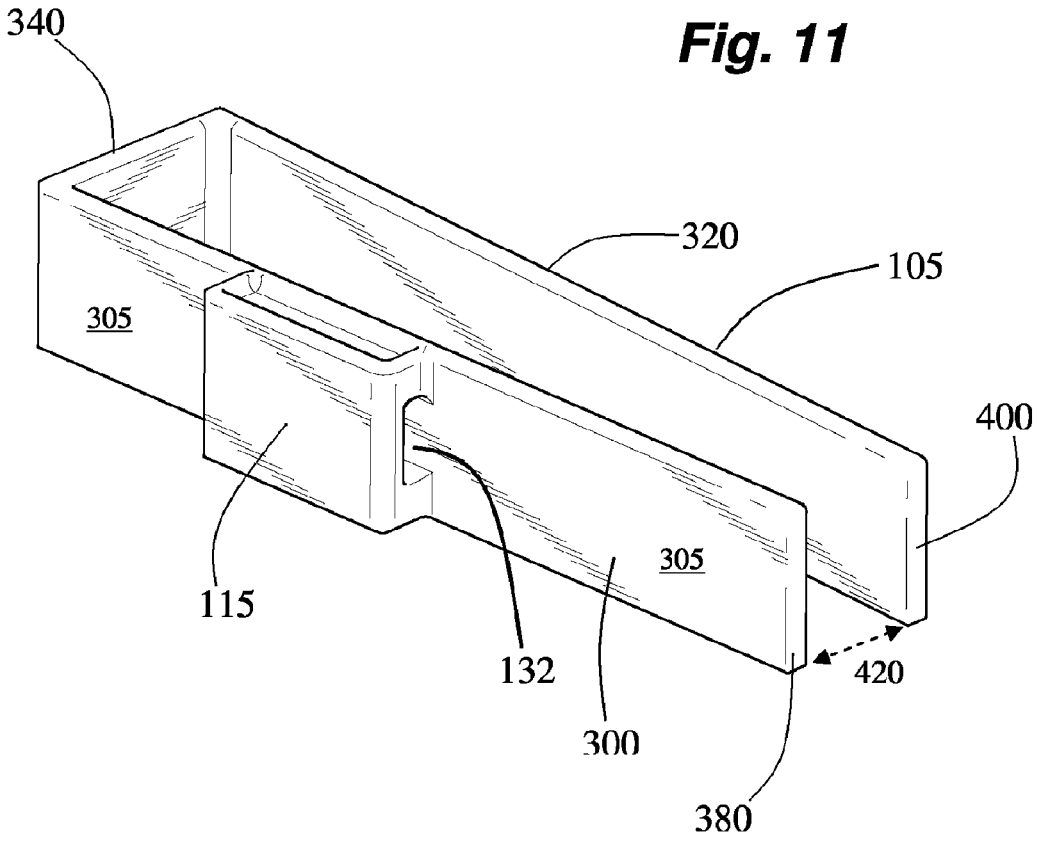
FIGS. 11 and 12 show perspective views of the door safety device shown in FIG. 1 without an anti-door-closing member.
Figure 12:
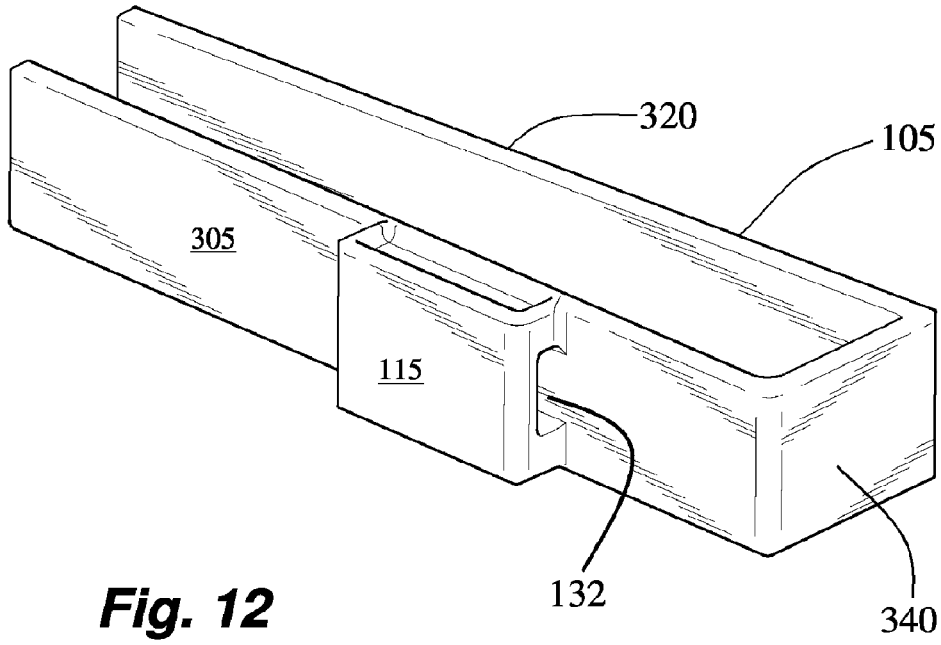

The casing 115 is attached to the first side 300 of the door clasp 105. More specifically, the casing 115 is connected to the exterior surface 305 of first side 300 and located between the proximal 340 and distal 360 ends of the door clasp 105, wherein the casing 115 has a proximal facing end 125 and a distal facing end 130, wherein the proximal facing end 125 and distal facing end 130 respectively face towards the proximal 340 and distal 360 ends of door clasp 105. The casing 115 has a through-bore 132 (shown in FIGS. 11 and 12) between the proximal and distal facing ends 125 and 130, respectively; the anti-door-closing member 110 has been omitted from FIGS. 11 and 12.

The through-bore 132 is sized to accommodate the elongated stem 440 of the anti-door-closing member 110 such that the elongated stem 440 slidably engages the through-bore 132 in response to sideways pressure applied to the anti-door-closing member 110. The stem button 520 and the raised spacer 500 are of sufficient size to prevent the anti-door-closing member 110 from sliding out of the casing 115. The proximal facing end 125 of the casing 115 is located a sufficient distance from the proximal end 340 of the door clasp 105 such that when the anti-door-closing member 110 is in the retracted position the raised spacer 500 is positioned alongside exterior surface 305 without extending beyond the closed proximal end 340 of the door clasp 105.

The various parts that make up the door safety device 100 can be made out of any suitable material. For example, the door clasp 105 can be made out of any suitable polymer such as a thermoplastic plastic. Alternatively, the door clasp 105 can be made out of a metal or metal alloy or can take the form of a plastic coated metal alloy or a painted metal alloy. The anti-door-closing member 110 can be made out of any suitable polymer such as plastic or a synthetic rubber compound. The casing 115 likewise can be made out of any suitable material such as plastic. The casing 115 can be integral with the door clasp 105.

In one embodiment the door safety device 100 includes a slope 560 (shown in FIGS. 13 through 16). The slope 560 extends from side 522 of stem button 520 to the exterior facing surface 112 of anti-door-closing member 110. The slope 560 helps protect member 500 from stresses that might otherwise occur if raised spacer 500 is pushed hard against proximal facing end 125 of casing 115. The slope 560 helps ensure that raised spacer 500 is brought to a controlled stop with respect to proximal facing end 125 of casing 115.

Figure 19:
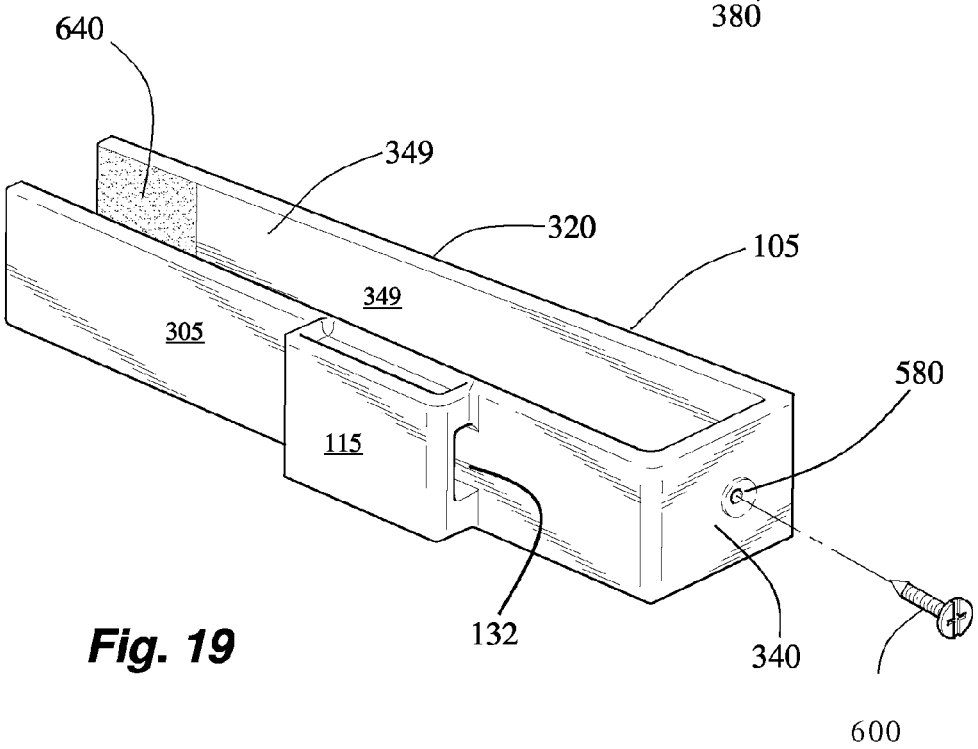
Figure 20:
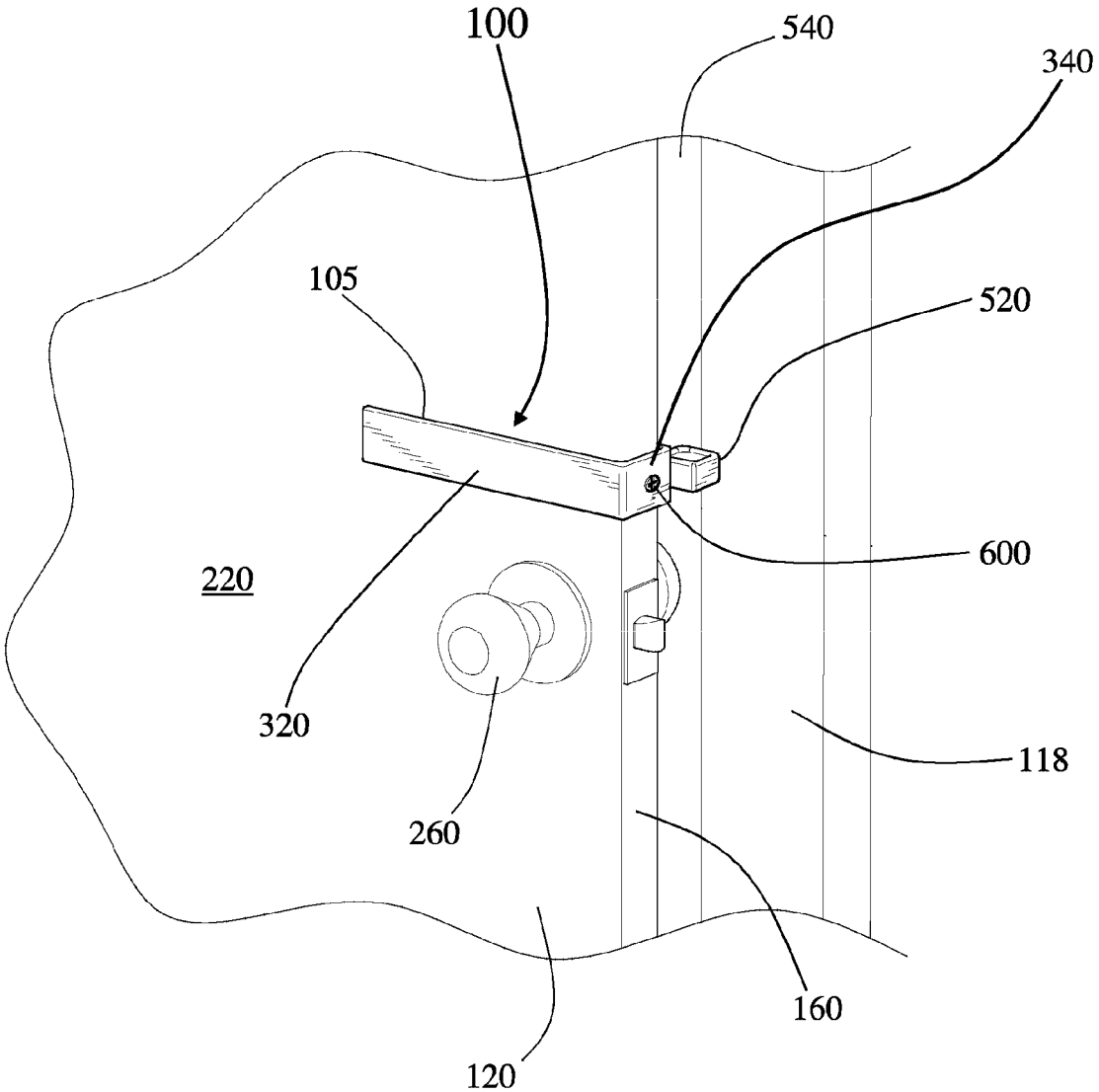
FIG. 20 shows an environmental view of a door safety device according to the present invention.
Figure 21:
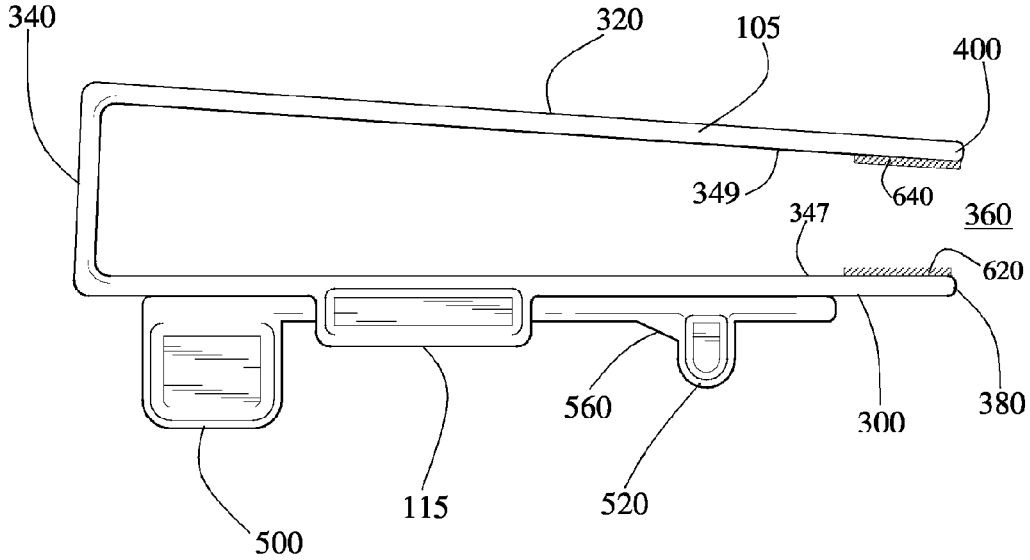
FIGS. 21 and 22 respectively show top and bottom views of a door safety device according to the present invention.
Figure 22:
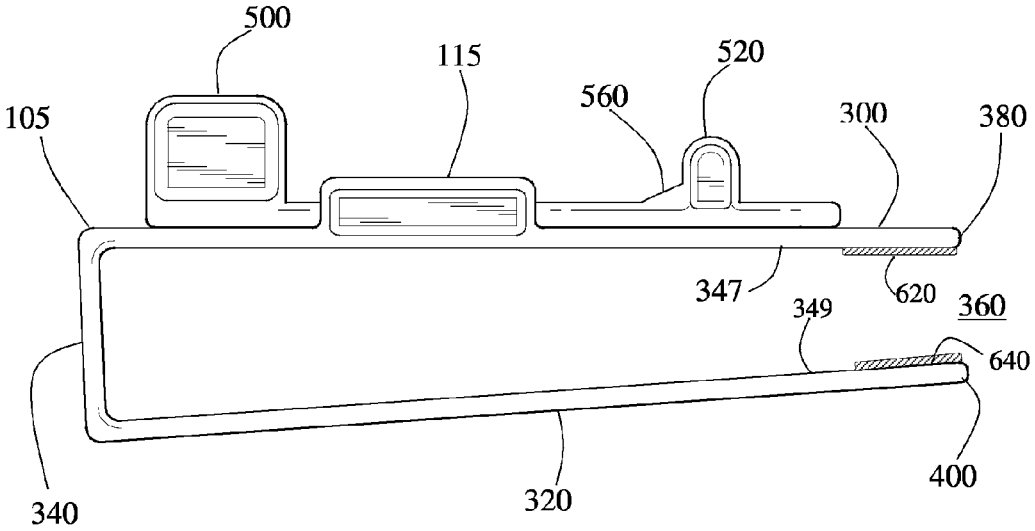
Figure 23:
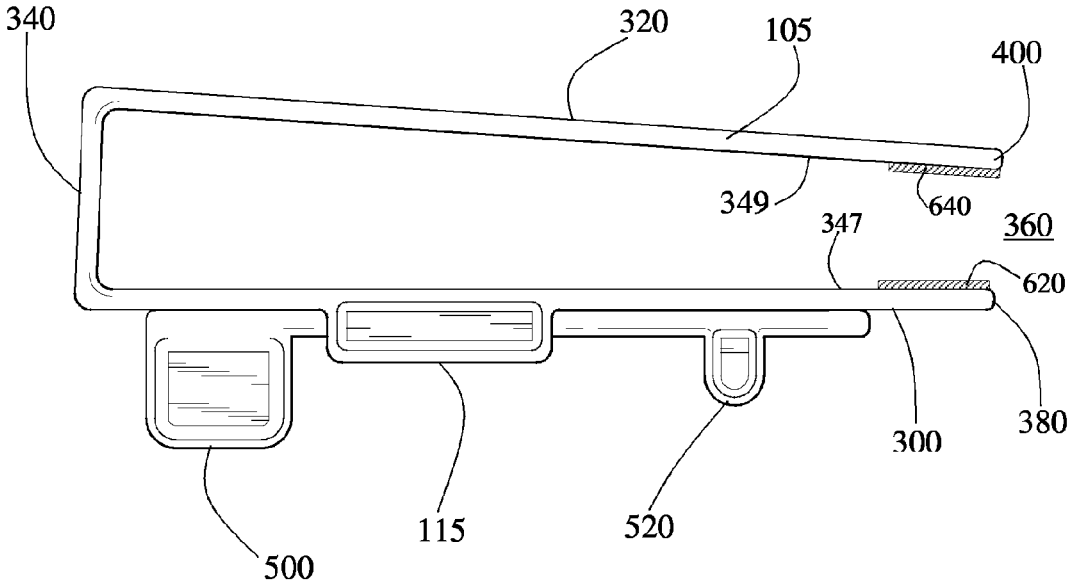
FIGS. 23 and 24 respectively show top and bottom views of a door safety device according to the present invention.
Figure 24:
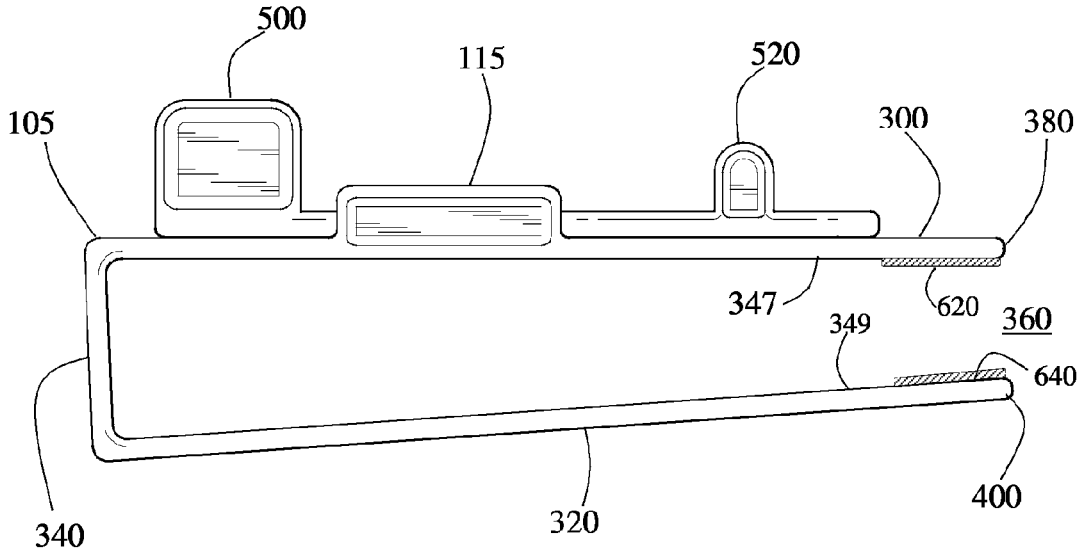

In one embodiment of the present invention the closed proximal end 340 includes a fastener hole 580 located therein as shown in FIG. 19. A fastener 600 is provided to allow a user to fasten the proximal end 340 of the door safety device 100 to the side edge 160 of a door panel 120 (see FIG. 20). The fastener 600 can be any suitable fastener such as, but not limited to, a screw.

The interior surfaces 347 and 349 proximate to first and second ends 380 and 400 are optionally lined respectively with first and second layers of high coefficient of friction material 620 and 640 (see FIGS. 21 through 24). The layers of high coefficient of friction material could be a layer of silicone rubber or, for example, compressible foam polymer.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed:

1. A door safety device for fitting to a door panel, the door panel having a hinged side edge, a side edge opposite the hinged side, an upper end, a lower end, and a door handle attached to the door panel proximal to the side edge opposite the hinged side edge of the door panel, said door safety device comprising:

a door clasp of generally U-shaped configuration but having opposite first and second elongated straight sides and a closed proximal end and an open distal end, wherein the first and second elongated straight sides define a gap therebetween, wherein the gap between the first and second elongated straight sides narrows continuously between the proximal end and the open distal end such that the closed proximal end defines an interior width, and the open distal end defines an open gap wherein the gap between the first and second elongated straight sides of the door clasp narrows continuously and progressively along the length of the door clasp such that the distal end open gap is narrower than the interior width of the proximal end, wherein during normal use said open distal end of said door clasp fits over the side edge of a door panel to provide a flush fit of the door clasp over the side edge of a door panel along the entire length of the first and second straight sides of the door clasp, said first elongated side of said door clasp defines an exterior surface of said first side;

an anti-door-closing member, said anti-door-closing member comprising an elongated stem having opposite distal and proximal ends, wherein the proximal end comprises a raised spacer, and wherein said distal end of said elongated stem includes a stem button; and a casing attached to the exterior surface of said first side of said door clasp, wherein said casing is located between said proximal and distal ends of said door clasp, wherein said casing defines a proximal stem-end and a distal stem-end, wherein said casing has a through-bore sized to accommodate said elongated stem of said anti-door-closing member such that said elongated stem of said anti-door-closing member slidably engages said through-bore in response to sideways pressure applied to said anti-door-closing member, wherein said stem button and said raised spacer are of sufficient size to prevent said anti-door-closing member from sliding out of said casing, and wherein said proximal stem-end of said casing is located a sufficient distance from said proximal end of said door clasp to allow said spacer to be positioned abutting said first side of said door clasp and not extending beyond said close proximal end of said door clasp, wherein said anti-door-closing member is moveable between a spacer withdrawn position and a spacer exposed position, wherein when said anti-door-closing member is in the spacer exposed position said spacer is extended at least partly beyond said closed proximal end of said door clasp, and wherein when said anti-door-closing member is in the spacer withdrawn position the spacer is located between the proximal end of said casing and the proximal end of said door clasp and therefore not in an exposed position beyond said proximal end of said door clasp.

2. A door safety device in combination with a door panel, the door panel having a hinged side edge, a side edge opposite the hinged side, an upper end, a lower end, and a door handle attached to the door panel proximal to the side edge opposite the hinged side edge of the door panel, said door safety device comprising: means for clasping the side edge of a door panel such that the door safety device fits flush on the door panel; means for preventing the door panel slamming; and means for casing said means for preventing a door panel slamming.

* * * * *